US007745382B2

(12) United States Patent
Sloan

(10) Patent No.: US 7,745,382 B2
(45) Date of Patent: Jun. 29, 2010

(54) SYNTHETIC LUBRICANT ADDITIVE WITH MICRO LUBRICATION TECHNOLOGY TO BE USED WITH A BROAD RANGE OF SYNTHETIC OR MINER HOST LUBRICANTS FROM AUTOMOTIVE, TRUCKING, MARINE, HEAVY INDUSTRY TO TURBINES INCLUDING, GAS, JET AND STEAM

(75) Inventor: Ronald John Sloan, Langley (CA)

(73) Assignee: BestLine International Research Inc., Schenectady, NY (US)

( * ) Notice: Subject to any disclaimer, the term of this patent is extended or adjusted under 35 U.S.C. 154(b) by 1148 days.

(21) Appl. No.: 11/290,596

(22) Filed: Dec. 1, 2005

(65) Prior Publication Data

US 2006/0160708 A1 Jul. 20, 2006

Related U.S. Application Data

(60) Provisional application No. 60/644,494, filed on Jan. 18, 2005.

(51) Int. Cl.
*C10L 10/16* (2006.01)

(52) U.S. Cl. ..... 508/591

(58) Field of Classification Search ..... 508/591
See application file for complete search history.

(56) References Cited

U.S. PATENT DOCUMENTS

| | | | |
|---|---|---|---|
| 3,406,419 | A | 10/1968 | Young |
| 3,984,599 | A | 10/1976 | Norton |
| 4,127,491 | A | 11/1978 | Reick |
| 4,131,551 | A | 12/1978 | Thompson |
| 4,218,330 | A | 8/1980 | Shubkin |
| 4,224,173 | A | 9/1980 | Reick |
| 4,228,021 | A | 10/1980 | Lenack |
| 4,504,404 | A | 3/1985 | Schumacher et al. |
| 4,534,873 | A | 8/1985 | Clark |
| 4,844,825 | A | 7/1989 | Sloan |
| 4,859,359 | A | 8/1989 | DeMatteo et al. |
| 4,956,122 | A | 9/1990 | Watts et al. |
| 5,120,358 | A | 6/1992 | Pippett |
| 5,136,118 | A | 8/1992 | Buchanan et al. |
| 5,202,040 | A | 4/1993 | Sanderson et al. |
| 5,332,516 | A | 7/1994 | Stephens |
| 5,364,994 | A | 11/1994 | Scharf |
| 5,431,841 | A | 7/1995 | Lockhart |
| 5,631,211 | A | 5/1997 | Nakagawa |
| 5,681,797 | A | 10/1997 | Lawate |
| 5,741,764 | A | 4/1998 | Patel et al. |
| 5,972,853 | A | 10/1999 | Boffa et al. |
| 6,008,164 | A | 12/1999 | Aldrich et al. |
| 6,046,142 | A | 4/2000 | Zilonis et al. |
| 6,143,701 | A | 11/2000 | Boffa |
| 6,413,916 | B1 | 7/2002 | Baumgart et al. |
| 6,761,645 | B1 | 7/2004 | Weber |
| 6,774,091 | B2 | 8/2004 | Dituro et al. |
| 6,858,567 | B2 | 2/2005 | Akao |
| 6,919,300 | B2 | 7/2005 | Dituro et al. |
| 6,962,895 | B2 | 11/2005 | Sharf |
| 6,992,049 | B2 | 1/2006 | Deckman et al. |
| 7,018,960 | B2 | 3/2006 | Negoro et al. |
| 7,022,766 | B2 | 4/2006 | Okada et al. |
| 7,109,152 | B1 | 9/2006 | Corby et al. |
| 7,124,728 | B2 | 10/2006 | Carey et al. |
| 2003/0040444 | A1 | 2/2003 | Garmier |
| 2003/0087769 | A1 * | 5/2003 | Dituro et al. ..... 508/185 |
| 2004/0077506 | A1 | 4/2004 | Arrowsmith et al. |
| 2006/0160708 | A1 | 7/2006 | Sloan |
| 2008/0182769 | A1 | 7/2008 | Sloan |

FOREIGN PATENT DOCUMENTS

| | | | |
|---|---|---|---|
| DE | 19723460 | A1 | 1/1998 |

(Continued)

OTHER PUBLICATIONS

Rudnick, Leslie R., Ed., Synthetic Mineral Oils and Bio Based Lubricants: Chemistry and Technology, Taylor & Francis (2006).

*Primary Examiner*—Walter D Griffin
*Assistant Examiner*—Frank C Campanell
(74) *Attorney, Agent, or Firm*—Jay R. Yablon

(57) ABSTRACT

It is known by the inventor that a universal synthetic lubricant additive that can greatly enhance the performance standards of existing lubricants, petroleum based or synthetic, imparts a new and desirable property not originally present in the existing oil or it reinforces a desirable property already possessed in some degree can greatly benefit the consumer. Although additives of many diverse types have been developed to meet special lubrication needs, their principal functions are relatively few in number. This universal synthetic lubricant additive (invention) with micro lubrication technology, when used as directed will reduce the oxidative or thermal degradation of the host oil, substantially reduce the deposition of harmful deposits in lubricated parts, minimize rust and corrosion, control frictional properties, reduce wear, temperature, sludge, varnishes and prevent destructive metal-to-metal contact, reduce fuel consumption and harmful emissions while improving performance through increased horsepower and torque. Further this technology lends itself to further development of a host of energy/emission reduction products from conditioners for kerosene, diesel, bunker-C heavy oils to gasoline, cutting oils, penetrating lubricants, electrical dielectric coatings, oxidation inhibitors and electrical terminal coatings.

13 Claims, No Drawings

FOREIGN PATENT DOCUMENTS

| | | | |
|---|---|---|---|
| EP | 0361180 | A1 | 4/1990 |
| EP | 0837122 | A2 | 4/1998 |
| EP | 1203803 | A1 | 5/2002 |
| EP | 1736529 | A1 | 12/2006 |
| JP | 07233001 | | 9/1995 |
| WO | 97019153 | | 5/1997 |
| WO | 0234867 | A1 | 5/2002 |
| WO | 033064571 | A1 | 8/2003 |
| WO | 2006100188 | A1 | 9/2006 |
| WO | 2007004789 | A1 | 1/2007 |
| WO | 2009078882 | A1 | 6/2009 |
| WO | 2009079020 | A1 | 6/2009 |
| WO | 2009085957 | A1 | 7/2009 |
| WO | 2009085967 | A1 | 7/2009 |

* cited by examiner

SYNTHETIC LUBRICANT ADDITIVE WITH MICRO LUBRICATION TECHNOLOGY TO BE USED WITH A BROAD RANGE OF SYNTHETIC OR MINER HOST LUBRICANTS FROM AUTOMOTIVE, TRUCKING, MARINE, HEAVY INDUSTRY TO TURBINES INCLUDING, GAS, JET AND STEAM

BACKGROUND OF THE INVENTION (1) Field of Invention

This field of invention relates to the latest technology in the development of a universal synthetic lubricant that can successfully be added to host oils based for mineral or synthetic base stocks. The product has shown to substantially reduce energy, wear and temperature along with harmful emissions with usefulness from heavy bunker-c to turbine lubricants.

(2) Description of Prior Art

Over the years a host of terms has arisen to identify additives and briefly denote the intended use and limited function. Thus the trade recognizes improvements when the synthetic lubricant additive is used such as an improved anti-oxidant (oxidation inhibitor), corrosion inhibitor, extreme pressure agent, anti-foaming agent, anti-wear agency, V.I. improver, pour point depressant, improved detergency and dispersant, anti-squawk agent in automatic transmissions and anti chatter agent when added to automatic transmission. The synthetic lubricant additive has beneficial results when used as directed in gasoline and diesel engines, gear boxes, automatic transmission, limited slip differential, steam and gas turbines, railroad and marine diesel engines, stationary piston engines, gasoline, diesel or steam, 2-cycle air-cooled and water cooled engines, hydraulic pumps and rams, cutting oils and industrial and marine reduction gear units. The synthetic lubricant additives contributes to many engineering advances, which contribute to quieter operation (reduce decibels), improved horsepower and torque, reduced wear, friction (energy consumption) heat and harmful emissions.

SUMMARY OF INVENTION

This invention relates to the use of a universal synthetic lubricant additive (invention) that can be added at various ratios to enhance most forms of lubricants from the simplest of lubrication oils such as automotive, truck, marine, locomotive, automatic and standard transmissions, differentials including limited slip, power steering fluid, hydraulic fluids, metal cutting, drilling, tapping and boring to the more advanced turbine engines such as steam, jet and gas.

Current and previous extreme pressure additives commonly used to enhance certain characteristics of the lubricant include zinc-phosphorus compounds, fatty acids, active sulfur compounds, lead, moly-disulfide, polymers, sulfur-phosphorus compound, carboxylic acid/esters, oxyphosphite compounds, polyisobutlyene, copolymers, polymethacrylate, styrene esters, chlorine concentrates and phosphorus.

The invention incorporates the use of the most advanced synthetic Alfa-Olefins (understood in the art to refer to Polymerized Alfa-Olefins or PAOs), Hydroisomerized base oils and the new synthetic Sulfonates and liquefied Polytetrafluoroethylene components and when combined in a specific sequence forms a finished product that exceeds any product on the market today. Each component is required to be blended in a specific sequence to maintain stability and its effectiveness as a multi-purpose synthetic lubricant additive. The results of the accurate blending procedure and temperature control allows for the finished product to effectively blend with synthetic, chemical, vegetable and solvent extracted mineral based lubricants.

As previously indicated, the blend of components when blended in a very specific sequence under specific conditions, will result in one of the finest forms of synthetic lubricant additive that can be effectively used with any form of lubricating products while not limited to just liquids but can be used in semi-liquids, pastes and solids to substantially enhance lubrication, reducing energy consumption, wear on moving or sliding components while substantially reducing both heat and wear in both boundary and hydrodynamic lubrication situations. The blending is via a combination of accurately controlled sheering and homogenization of the components resulting in a long-term stable blend. Once blended in a specific sequence, simple purification or physical separation, such as distillation or freezing, does not constitute synthesis.

The finished product is a combination of:

Polymerized Alfa-Olefins

"Hydrolsomerized High VI (viscosity index) HT (hydrotreated, Severe Hydro-cracked) Base Stock"

Synthetic Sulfonates

Vacuum Distilled Non-Aromatic solvents (−0.5% Aromatic)

Liquefied Polytetrafluoroethylene, (PTFE), comprising a stable aqueous dispersion of PTFE particles in water.

Synthetic lubricants have been successfully used for some time as a jet engine lubricant, lubricants for extreme cold (arctic) conditions in a limited number of motor oils and fire resistant hydraulic fluids. Despite their higher cost, they do offer advantages over distilled mineral based petroleum lubricants to the consumer such as; reduced oil consumption, extended oil life, improved cold weather starting and some reduction in fuel consumption. Vegetable based synthetic lubricants such as corn; castor bean and jahba bean oil were used primarily as machine oils with very limited lubricity advantages. Most synthetic oils on the market today lack in ability to resist meta-to-metal wear under extreme pressure situations and allow metal-to-metal contact or galling under such conditions.

DESCRIPTION OF PREFERRED EMBODIMENT

The preferred blending ratios for each of the components are shown as below. It is important to maintain a blend of components that fall within the following percentages:

Polymerized Alfa-Olefins: 20-60 Volume Percent. Preferable Volume Approximately 55 Percent.

Hydroisomerized High VI (viscosity index) HT (hydrotreated, severe hydro-cracked) Base Oil (viscosity grade 32); 15-55 Volume Percent. Preferable Volume 15 to 25 percent, and most preferable volume Approximately 21 Percent.

Synthetic Sulfonates 6477-C: 300TBN; 0.5-10 Volume Percent. Preferred Volume Approximately 2 Percent Vacuum Distilled Non-Aromatic Solvent (−0.5% Aromatic) 10-40 Volume Percent. Preferred Volume Approximately 21.55 Percent.

Liquefied Polytetrafluoroethylene (PTFE): 0.001-10% Volume Percent. Preferable Volume Approximately 0.45 Percent. Liquefied PTFE must be used to avoid agglomeration.

Preferred Sequence of Blending Components

It is necessary to blend the components in a specific manner to ensure optimum shelf life, freedom of separation and the most optimum advantage in the application of the product as an extreme pressure lubricant additive. The flow of product must blend for a minimum of six (6) hours through a series of homogenizers and sheering pumps. The flow of the various components will follow a sequence which allows the process whereas the chemical conversion or transformation of one very complex mixture of the molecular structure to another complex mixture of molecules. The blending process allows this complex change to take place. It is recommended that the mixture should process at a minimum of approximately 140 degrees Fahrenheit or 60 degrees Celsius yet should not exceed 170 degrees Fahrenheit or 77 degrees Celsius while in the processing tanks. The time and temperature sequence ensure that the molecular change takes place systematically without adverse modification of the viscosity or color. The minimum temperature grid will ensure maximum expansion of the molecules prior to sheering of the blend of components. During this process, solvent must be injected into the blend to eliminate air entrapment.

Preferred Blending Equipment

The (process) sequence involves a series of blending and holding tanks where the product can be pumped through control valves to maintain consistent flow and pressure. The components will be initially blended via a high frequency homogenization prior to processing at the sheering pumps. The effect of the sheering will not take place until the temperature meets or exceed the prescribed minimum temperature. Electrical banding of the tanks with temperature-controlled thermostats can be used to speed the procedure providing the mixture is under constant movement and strict monitor of the liquid is maintained. Size or volume of the tanks is not an important factor in the blending process.

Universal Use of Invention

In the many tests conducted, the product shows compatibility with conventional motor oils, gear oils, hydraulic fluids, (not brake fluids) along with the various blends of synthetic lubricants. Tests were conducted to establish stability of the additive when blended with various host lubricants, to analysis oxidation, viscosity change, resistance to extreme pressure and effect on power and torque output. The invention performed admirably and impressed all the technical folks involved in the many test completed.

The invention has proven to have far reaching value as the additive can be used as a base component to develop a host of valued effective products such as fuel conditioners, gasoline, diesel, kerosene, bunker-c along with soluble and non-soluble cutting oils, form oil for concrete application, corrosion inhibitors on electric terminals while at the same time reducing electrical resistance, at electrical terminal yet providing over 34 KV of dielectric strength.

The invention has been tested on a variety of metal skins including jet turbine blades and fiberglass gel coatings to demonstrate a successful reduction of both oxidation and wind and water resistance. Research has further shown that the overlying possibilities for use of this product, is far reaching and will have enormous benefits for consumers worldwide from reducing harmful emissions to overall reduced energy consumption.

Testing Procedures

ASTM D testing of the product through the use of the Block-on-Ring Tester and the Seta Shell Four Ball Test machine can demonstrate the product for its effect as an extreme pressure additive. Each of these test machines incorporate a rotating steel surface applied against a fixed steel surface while submerged in a bath of lubricant. Pressure is applied and noted as KGF (kilogram force) applied to the mating surface while the rotate is set for a fixed RPM (revolution per minutes).

Further numerous qualified engine tests were completed including small engines, 2-cycle, steam turbines, jet turbines, gasoline and the CRC L-38. Once again these test have demonstrated the ability of the lubricant to perform on a universal application. Further to demonstrate the protective coating left on the treated metal. Test four cylinder engines have been stripped of valve covers, oil pans, oil-pumps/filters and with only the molecular thin film of product on the moving component and distributor parts have successfully run without either oil or water coolant both on the bench stand and while completely submerged under water. These test have been run repeatedly and recorded before of professional engineers. The engines have been recorded to run in excess of 25 minutes while completely submerged under water. The motors were later stripped and the components reviewed and re-weighed with little sign of wear. Further tests were conducted and recorded with a selection of test recorded below.

Test Results from Various Test Programs

Test #1

Testing has been completed on a CRC L-38 Engine Stand ASTM D 5119-90 (American Standard Testing Methods)

This rigorous test was conducted at the prestigious PerkinElmer Fluid Science Automotive Research Center (formerly EG&G Automotive Research) and is located at 5404 Bandera Road, San Antonio, Tex.

PerkinElmer is one of the largest independent automotive testing organizations in the world. PerkinElmer has been providing testing to the automotive manufacturers and petrochemical industry since 1953. Their customer are world wide, and include Shell Oil, Mobil Oil, Chevron, Exxon, Castrol, Pennzoil, Petro-Canada etc., along with automotive OEM's, heavy-duty engine OEM, OEM suppliers and fuel and lubricant companies. PerkinElmer was designated as the United States Petroleum Task force to regulate and e control the quality and acceptance of regulated additives.

PerkinElmer was contracted to test the Synthetic Lubricant Additive (invention) when combined with an off the shelf motor oil. The reference oil used in the test was rated as a licensed API (American Petroleum Institute) motor oil, having some degree in the test. The test is a grueling 40 hours of severe running conditions plus 13 hours of run up and run down time. The engine is run under full load at a maximum RPM (3150 revolutions per minute) extreme oil temperatures of 290 degrees Fahrenheit (143.3 degrees Celsius) with fuel to run abnormally rich at 4.5 lbs per hour.

The test is designed to break the oil down, prematurely wearing away the piston rod bearings while have an adverse effect on the viscosity of the engine oil. The reduced viscosity of the oil can create excessive wear and increased amount of sludge and varnish.

Results of the Test

The scoring is based on a reference oil test on a particular machine. The reference oil must have passed the test on one of the many test machines. As all the test engines are not equal so each engine is pre-tested for the reference comparison. The maximum allowable bearing loss is 40 mg of copper for the piston rod bearing. Sludge and varnish deposits are scored best out of 10 points, with 10 being perfect or a total of 60 points for each test.

The test engine assigned was rated as the toughest engine to pass on. The reference oil scored a weight loss of 27.7-mg. of copper while the oil with the synthetic lubricant additive (invention) lost a total of 9.0 mg. The engineer overseeing the test commented that it was one of if not the best test he has seen in over 10 years of service with PerkinElmer. Further the results of viscosity, sludge and varnish were near perfect score. Out of a total of 60 possible points, the test with the synthetic lubricant additive (invention) scored 58.30 and 58.80 respectively in varnish and sludge.

Test #2

Oil Analysis

Sample oil was drawn from the running engine every 10 hours and analyzed to compare the used oil with the oil prior to running.

| | New | 10 Hours | 20 Hours | 30 Hours | 40 Hours |
|---|---|---|---|---|---|
| Acid Number | 2.00 | 2.90 | 3.50 | 3.80 | 4.00 |
| Viscosity cSt 40 C. | 102.90 | 101.90 | 101.60 | 101.50 | 102.10 |
| Viscosity cSt 100 C. | 14.13 | 13.89 | 13.82 | 13.79 | 13.84 |
| Viscosity Increase CSt 40 C. | | −0.97 | −1.26 | −1.36 | −0.78 |
| Viscosity Increase CSt 100 C. | | −1.70 | −2.19 | −2.41 | −2.05 |

Test #3

Primary Parameter of Engine Deviations

Tests were conducted on the various engine components on the completion of the test to evaluate any changes the test oil with the added invention may have had on the engine.

| Percentage | Permitted Deviation | Calculated Deviation |
|---|---|---|
| Engine Oil Gallery Temperature | 2.5% | 0.0 |
| Engine Coolant Outlet Temperature | 2.5% | 0.0 |
| Engine Coolant Delta Temperature | 2.5% | 0.0 |
| Fuel Flow | 2.5% | 0.0 |
| Crankcase Off Gas Std FT (3) h | 2.5% | 0.0 |
| Oil Pressure, PSI | 2.5% | 0.0 |
| Engine Speed, RPM | 5.0% | 0.0 |
| AFR | 5.0% | 0.0 |
| Exhaust, in Hg. | 5.0% | 0.0 |

Test #4

Seta-Shell Four Ball Extreme Pressure Test (ASTM D-2783-82)

In this test three steel test balls are locked in a holding cup while a fourth ball is fixed in a rotating chuck. Lubricant is applied to the container holding the fixed and rotating bearings. Pressure is loaded on the force arm and electric motor is started. The electric DC motor is set to run at a specified RPM for a specified time such a 10.0 seconds in this test.

| Test Sample | Load K.G.F | Time/ Seconds | A/ Temp | Scar Size Length | Width |
|---|---|---|---|---|---|
| Invention | 500 | 10.0 | 76 | 0.803 | 1.064 |
| Invention | 780 | 10.0 | 76 | 1.043 | 1.337 |
| Texaco 10W30 | 780 | 10.0 | 65 | 2.940 | 2.440 |
| Plus 10% SLA | 780 | 10.0 | 65 | 2.160 | 2.020 |
| Esso 10W30 | 780 | 10.0 | 65 | 2.910 | 2.510 |
| Plus 10% SLA | 780 | 10.0 | 65 | 2.210 | 2.160 |
| Motor Master 30 | 780 | 10.0 | 72 | 5.00 | 3.857 |
| Plus 10% SLA | 780 | 10.0 | 72 | 2.074 | 1.951 |
| Hydraulic AW46 | 780 | 10.0 | 72 | 2.900 | 2.320 |
| Plus 10% SLA | 780 | 10.0 | 72 | 1.240 | 1.220 |

Notes:
K.G.F. = Kilogram Force
Weld or Failure = Score of 4.00 or greater
SLA = Synthetic Lubricant Additive (Invention)

Test #5

Analytical Report

A sample of the invention has been identified and tested with the analytical results posted below.

| | | |
|---|---|---|
| Flash Point 342 F. | 172.2 C. | ASTM D 92 |
| Specific Gravity | 1.036 | ASTM D 1298 |
| Total Base No. Mg KOH/g | 1.6 | ASTM D 2896 |
| Copper Corrosion | 1A No Corrosion | ASTM D 130 |
| Pour Point | −40 F. −40 C. | ASTM D 97 |
| Viscosity | | |
| 104 F. 40 C. | 914 | ASTM D 88 |
| 212 F. 100 C. | 78 | ASTM D 88 |
| Kinetic cST | 200 | ASTM D 445 |
| Kinetic cSt | 15.2 | ASTM D 445 |
| Ash Content | 0.277 | ASTM D 482 |

Test #6

Metal Analysis

A sample of the invention was subjected to a metal analysis with the results posted below.

| | |
|---|---|
| Aluminum | ND |
| Barium | ND |
| Copper | ND |
| Chromium | ND |
| Iron | ND |
| Lead | ND |
| Molybdenum | ND |
| Nickel | ND |
| Zinc | ND |
| Silver | ND |
| Tin | ND |
| Vanadium | ND |
| Calcium | 2900 |
| Magnesium | ND |
| Sodium | ND |
| Phosphorus | ND |
| Sulphur | ND |

Test #7

Block on Ring Test

Block on Ring Machine. Ring O.D.=40 mm (1.57") at 800 RPM (329 FPM) on this test. 1700 RPM (699FPM) is maximum speed, but is not used to avoid heat build up. No cooling arrangement.

Oil Specimen flows at 50 ml/min. (0.013209 GPM, 3.05127 Cu. In./Min.) Std. Roller bearing with outer race of AISI 52100 steel. Mating blocks may be white metal, bronze on steel C 0.9, Mn 1.2, Cr 0.5, W 0.5, V 0.1 (2510 AFNOR 90 MCW5 Case Hdn. To 58HRC) Load on different blocks: steel/steel=1075 RPM, bronze/steel=358 RPM, white metal/Steel=179 RPM.

Test Routine:

First adjust the speed, and then load is steadily increased to maximum permitted, within 5 minutes. Each test was then run for ½ hour. Recordings made for maximum friction force, minimum friction force after run-in period. Stable curve at end of test and maximum temperature recorded.

After completion of over 80 tests, SEM (Scanning Electron Microscope) studies, for material reference and wear track studies.

| Friction Reduction | |
|---|---|
| 10% Addition of Synthetic Lubricant Additive (SLA) Invention | |
| Mineral Base Oil Plus SLA | −10.6% |
| Synthetic Base Oil plus 15% SLA | −10.6% |
| 15% Addition of Synthetic Lubricant Additive (SLA) Invention | |
| Mineral Base Oil Plus SLA | −14.9% |
| Synthetic Base Oil Plus SLA | −48.9% |
| **Temperature Reduction** | |
| 10% Addition of Synthetic Lubricant Additive (SLA) Invention | |
| Mineral Base Oil Plus SLA | −26.5% |
| Synthetic Base oil plus SLA | −17.0% |
| 15% Addition of Synthetic Lubricant Additive (SLA) Invention | |
| Mineral Base Oil Plus SLA | −36.0% |
| Synthetic Base Oil plus SLA | −38.7% |
| **Wear Reduction** | |
| 10% Addition of Synthetic Lubricant Additive (SLA) Invention | |
| Mineral Base Oil Plus SLA | −60.6% |
| Synthetic Base Oil Plus SLA | −40.3% |
| 15% Addition of Synthetic Lubricant Additive (SLA) Invention | |
| Mineral Base Oil Plus SLA | −78.8% |
| Synthetic Base Oil Plus SLA | −50.7% |

SLA=Invention

Test #8

A brand new NASCAR engines was provided for testing on a dynamometer. The engine was run in on Kendall® Racing Oil and numerous pulls were performed. The invention was then added to the Kendall® Racing Oil at a 10% ratio (20 parts oil to 2 parts invention). The test is posted as below.

Dynamometer Test on 358 Cu. In. GM Engine (5.8 Liter)

The NASCAR Engine was set up and run in to full operating temperature at speeds to 6900 RPM. After multiple runs with Kendall® Racing 20W50 Racing oil, the maximum results were recorded in both horsepower and torque.

The invention was then added at a 10% ratio and the tests repeated with maximum results recorded.

Results:

STPPwr-Chp Kendall® Maximum Horsepower=494

STPPwr-Chp with 10% Invention added to Kendall®, Horsepower=508

STPTrq-Clb-ft Kendall® Maximum Torque=399

STPTrq-Clb-ft Kendall® plus 10% Invention added, Torque=411

Test #9

Copper Corrosion Test ASTM D 130

The tests were carried out on polished copper blanks are submerged for 3 hours at a 100 degrees C. on both the invention (concentrated synthetic lubricant additive) and a number of its blended by-products. The blanks are withdrawn, washed in Stoddard's solvent and the colors of the blanks compared with the chart. The results of the tests consistently revealed 1-A, No Corrosion.

Test #10

Rheological Evaluation

Rheological evaluation was performed on the invention when blended with various conventional motor oils. The test is to examine the effect the invention can have when blended with the host oil. The samples oils tested with 10% and 15% addition of the invention, displayed Newtonian behavior at all temperatures tested. The treated oils displayed a substantial improvement of thermal degradation with the addition of the invention. Using standard regression techniques the variations of oil viscosities with each temperature was found to follow the Arrhenius model, AE/RT (n=Ae).

Test #11

Sequence VIB

The Sequence VUB is an engine dynamometer test that measures a lubricant's ability to improve fuel economy of passenger cars and light-duty trucks. The method compares performance of a test lubricant to the performance of a baseline lubricant over five different stages of operation. The Engine Testing Division of Southwest Research Institute performed this Test®

A 1993 Ford 4.6 L spark ignition, V-8 cylinder design, 4-cycle engine was used as the test apparatus. The engine incorporate overhead camshafts, a cross-flow, fast-burn cylinder head design, two valves per cylinder, and electronic port fuel injection. The test incorporated the use of the product applied in the patent application, blended with an off the shelf non-GF-4 engine oil.

The sequence incorporated a flush and run type procedure. Each test consisted of two 5-stage fuel economy measurements on baseline oil (BC), one at the beginning of the test and one at the end. The test oil was evaluated between the two baseline runs. The test oil was initially aged for 16 hours of engine operation at 1500 RPM/Min and 125 degrees C., oil temperature. After the initial aging, a 5-stage fuel economy measurement was taken. The test oil was then aged for an additional 80 hours at an engine speed of 2250 RPM and 135 degrees C. oil temperature. Following the final aging, the test oil once again went through a 5-stage fuel economy measurement. The two economy measurements taken on the baseline oil (BC) and final value for Fuel Economy was calculated for the oil test.

Results:

The test passed the Sequence VIB exceeding the pass/failure standards set by the Council for ASTM VIB procedure D6837-02 and was recorded for reference by the American Chemistry Council (ACC).

Test #12:

Sequence VIBSJ

A Sequence VIBSJ was performed on a similar stand as the Sequence VIB as outline in Test #11. A different engine stand was used to test and measure the fuel economy of the applicant product, when added to engine oil and via a blend to the gasoline. This test was performed by the Engine Testing Division of Southwest Research Institute of San Antonio, Tex.

Results:

Although this is not an ASTM D standard test, the test was conducted in a professional manner to Record fuel economy at various stages. The results were positive with fuel saving in each stage.

The invention claimed is:

1. A synthetic lubricant additive, comprising:

(a) polymerized alpha-olefins;

(b) hydrolsomerized high viscosity index hydro-treated, severe hydro-cracked base oil (ISO viscosity grade 32);

(c) synthetic sulfonates;

(d) vacuum distilled non-aromatic solvent less than 0.5% aromatic by volume; and (e) between 0.001 and 10 volume percent liquefied polytetrafluoroethylene (PTFE), comprising a stable aqueous dispersion of PTFE particles in water.

2. The synthetic lubricant additive of claim 1 comprising 55 percent by volume of said polymerized alpha-olefins.

3. The synthetic lubricant additive of claim 1 comprising between 15 and 25 percent by volume of said hydroisomerized high viscosity index hydro-treated, severe hydro-cracked base oil.

4. The synthetic lubricant additive of claim 1 comprising between 0.025 and 3 percent by volume of said liquefied polytetrafluoroethylene.

5. The synthetic lubricant additive of claim 1 comprising between 17 and 25 percent by volume of said vacuum distilled non-aromatic solvent.

6. A synthetic lubricant additive, comprising:

(a) 55 percent by volume of polymerized alpha-olefins;

(b) 21 percent by volume of a hydrolsomerized high viscosity index hydro-treated, severe hydro-cracked base oil (ISO viscosity grade 32);

(c) 2 percent by volume of synthetic sulfonates;

(d) 21.55 percent by volume of vacuum distilled non-aromatic solvent less than 0.5% aromatic by volume; and (e) 0.45 percent by volume of liquefied polytetrafluoroethylene (PTFE), said liquefied polytetrafluoroethylene comprising a stable aqueous dispersion of PTFE particles in water.

7. A motor oil composition, comprising:

(a) between 85 and 90 percent by volume of motor oil; and (b) between 10 and 15 percent by volume of the synthetic lubricant additive of claim 1.

8. A method of producing the synthetic lubricant additive of claim 1, comprising:

(a) blending between 20 and 60 percent by volume of alpha-olefins with 20 to 55 percent by volume of hydrolsomerized base oil;

(b) blending between 10 to 40 percent by volume of vacuum distilled non-aromatic solvent less than 0.5% aromatic by volume with 0.5 to 10 percent by volume of synthetic sulfonates; and (c) blending the blend from (a) and (b) with 0.001 to 10 percent by volume of polytetrafluoroethylene.

9. A method of producing the synthetic lubricant additive of claim 1, comprising:

(a) blending approximately 20 to 60% by volume of alpha-olefins with approximately 20% by volume hydroisomerized High VI HT base oils;

(b) Blending approximately 1 percent by volume of non-aromatic solvents less than 0.5% aromatic by volume with 1 percent by volume of synthetic sulfonates;

(c) blending the blend from (a) and (b) with 20 percent by volume of said non-aromatic solvent; and (d) blending the blends from (a), (b) and (c) with 1 percent by volume of liquefied polytetrafluoroethylene.

10. A motor oil, comprising:

(a) twenty parts by volume of conventional mineral based motor oil;

(b) twenty parts by volume of synthetic based motor oil; and (c) 2 parts by volume of the universal synthetic lubricant additive of claim 1.

11. The synthetic lubricant additive of claim 1, comprising:

(a) said polymerized alpha-olefins between 20 and 60 percent by volume;

(b) said hydroisomerized high viscosity index hydro-treated, severe hydro-cracked base oil (ISO viscosity grade 32) between 20 and 55 percent by volume;

(c) said synthetic sulfonates between 0.5 and 10 percent by volume;

(d) said vacuum distilled non-aromatic solvent between 10 and 40 percent by volume; and (e) said liquefied polytetrafluoroethylene between 0.001 and 10 percent by volume.

12. The motor oil composition of claim 7, wherein said motor oil comprises a conventional motor oil.

13. The motor oil composition of claim 7, wherein said motor oil comprises a synthetic motor oil.

* * * * *